US010545448B2

(12) United States Patent
Sugiyama et al.

(10) Patent No.: US 10,545,448 B2
(45) Date of Patent: Jan. 28, 2020

(54) IMAGE FORMING APPARATUS

(71) Applicant: SHARP KABUSHIKI KAISHA, Sakai, Osaka (JP)

(72) Inventors: Akira Sugiyama, Sakai (JP); Hiroshi Tachiki, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/200,260

(22) Filed: Nov. 26, 2018

(65) Prior Publication Data

US 2019/0163110 A1 May 30, 2019

(30) Foreign Application Priority Data

Nov. 30, 2017 (JP) ..... 2017-230622

(51) Int. Cl.

| | |
|---|---|
| ***G03G 15/08*** | (2006.01) |
| ***G03G 15/00*** | (2006.01) |
| ***G03G 15/16*** | (2006.01) |
| ***B65H 5/36*** | (2006.01) |

(52) U.S. Cl.
CPC ..... *G03G 15/657* (2013.01); *B65H 5/36* (2013.01); *G03G 15/1635* (2013.01); *G03G 15/6502* (2013.01)

(58) Field of Classification Search
CPC ..... G03G 15/1635; G03G 15/657; G03G 15/6502; G03G 2221/1654
USPC ..... 399/107, 110, 121, 122, 124, 125
See application file for complete search history.

(56) References Cited

U.S. PATENT DOCUMENTS 9,651,913 B2 * 5/2017 Koshida ..... B65H 29/52

FOREIGN PATENT DOCUMENTS

JP 2002-229348 A 8/2002

* cited by examiner

*Primary Examiner* — Hoan H Tran
(74) *Attorney, Agent, or Firm* — ScienBiziP, P.C.

(57) ABSTRACT

An image forming apparatus includes a photoconductor unit that supports a photoconductor drum, a transfer roller brought into pressure contact with the photoconductor drum, a transfer unit that supports the transfer roller, a sheet guide provided between the photoconductor unit and the fixing unit, and a support holder that supports the transfer unit and the sheet guide. The support holder moves to bring the transfer unit and the sheet guide into and out of contact with the photoconductor unit and the fixing unit. The transfer unit is provided with a transfer positioning section that positions the transfer unit by coming into abutment therewith. The sheet guide is provided with a guide positioning section that positions the sheet guide by coming into abutment therewith. The transfer unit and the sheet guide are joined to each other by an engagement unit that engages the two with each other.

6 Claims, 5 Drawing Sheets

IMAGE FORMING APPARATUS

BACKGROUND

1. Field

The present disclosure relates to image forming apparatuses that transfer toner images formed on photoconductors onto sheets.

2. Description of the Related Art

An electrophotographic image forming apparatus forms an image onto a sheet conveyed along a sheet conveying path by performing, on the sheet, for example, a toner-image transfer process and a fixing process using heat and pressure. In recent years, there has been proposed an image forming apparatus in which the sheet conveying path can be externally exposed by moving a part of a housing in view of, for example, conveyance failure and maintenance. For example, see Japanese Unexamined Patent Application Publication No. 2002-229348.

In the image forming apparatus according to Japanese Unexamined Patent Application Publication No. 2002-229348, a sheet conveyance guide disposed between a transfer-roller support member and a fixing unit is attached to a right door in a vertically movable manner. By closing the right door, the sheet conveyance guide is positioned between the transfer-roller support member and the fixing unit.

The transfer-roller support member has a complex structure in which the transfer-roller support member is disposed in a rotatable manner about a shaft of a registration roller disposed in the image forming apparatus and is biased toward a photoconductor by moving in conjunction with the closing operation of the right door. Therefore, there is a problem in that the structure for positioning the sheet conveyance guide and the transfer-roller support member by bringing the two into engagement with each other is large in size. Furthermore, even if the sheet conveyance guide and the transfer-roller support member can be satisfactorily engaged with each other, there is still a concern that the sheet conveyance guide may be disposed in a tilted manner in the fixing unit. If the sheet conveyance guide is not to be provided with a part for positioning the sheet conveyance guide relative to the fixing unit, there is a problem in that the sheet conveyance guide may become incapable of moving. Moreover, when the sheet conveyance guide deforms by receiving transfer heat, the gap between the sheet conveyance guide and the transfer-roller support member or the fixing unit tends to change easily, possibly causing a paper jam to occur as a result of the conveyed sheet becoming stuck in the gap.

SUMMARY

It is desirable to provide an image forming apparatus that can achieve improved positional accuracy for each component and that can perform a stable sheet conveying process.

According to an aspect of the disclosure, there is provided an image forming apparatus that transfers a toner image formed on a photoconductor onto a sheet. The image forming apparatus includes a sheet conveying path along which the sheet is conveyed in a conveying direction, a photoconductor unit that supports the photoconductor, a transfer roller that is brought into pressure contact with the photoconductor via the sheet conveying path, a transfer unit that supports the transfer roller, a sheet guide that is provided between the photoconductor unit and a fixing unit and that guides the sheet in the conveying direction, and a support holder that supports the transfer unit and the sheet guide. The support holder moves to bring the transfer unit and the sheet guide into and out of contact with the photoconductor unit and the fixing unit. The transfer unit is provided with a transfer biasing member between the transfer unit and the support holder and is also provided with a transfer positioning part that positions the transfer unit by coming into abutment with the photoconductor unit. The sheet guide is provided with a guide biasing member between the sheet guide and the support holder and is also provided with a guide positioning part that positions the sheet guide by coming into abutment with the fixing unit. The transfer unit and the sheet guide are joined to each other by an engagement unit that engages the transfer unit and the sheet guide with each other.

DESCRIPTION OF THE EMBODIMENTS

First Embodiment

An image forming apparatus according to a first embodiment of the present disclosure will be described below with reference to the drawings.

Figure 1:
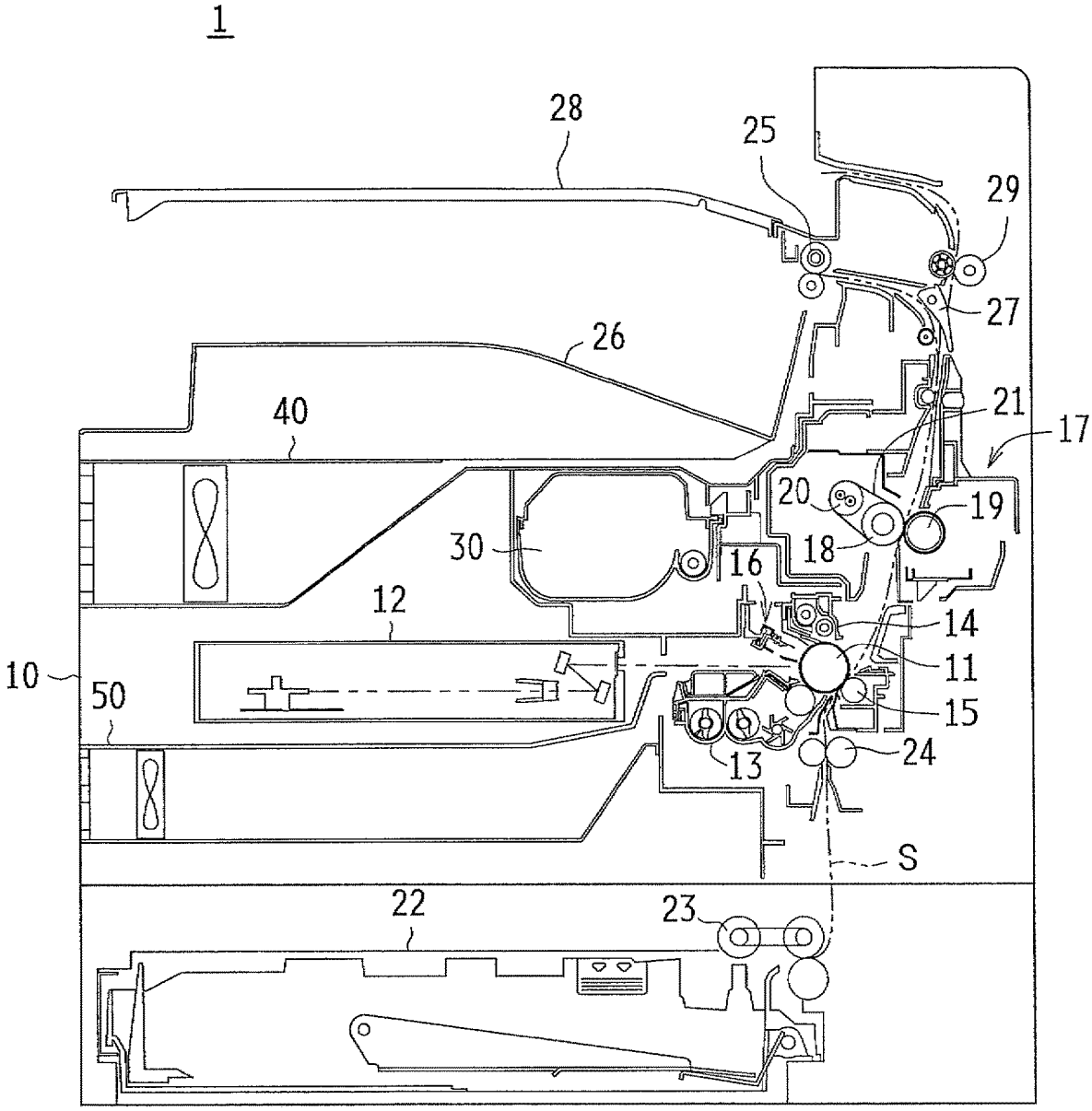
FIG. 1 is a side view schematically illustrating an image forming apparatus according to a first embodiment of the present disclosure.

FIG. 1 is a side view schematically illustrating the image forming apparatus according to the first embodiment of the present disclosure.

An image forming apparatus 1 forms a monochrome image onto a predetermined sheet in accordance with image data transmitted from an external unit. A housing 10 of the image forming apparatus 1 is provided with a photoconductor drum 11 (as an example of a photoconductor), an exposure device 12, a developing device 13, a cleaning device 14, a transfer roller 15, a charging device 16, a fixing unit 17, a sheet conveying path S, a sheet feed cassette 22, a sheet output tray 26, an auxiliary tray 28, a toner bottle 30, a duct 40, and an auxiliary duct 50.

The photoconductor drum 11 is disposed along the sheet conveying path S and is rotationally driven. The charging device 16 uniformly electrostatically charges the surface of the photoconductor drum 11 to a predetermined potential. The exposure device 12 exposes the surface of the photoconductor drum 11 to light so as to form an electrostatic latent image thereon. The developing device 13 develops the electrostatic latent image on the surface of the photoconductor drum 11 so as to form a toner image on the surface of the photoconductor drum 11.

The transfer roller 15 and the photoconductor drum 11 have a nip region therebetween. A sheet conveyed on the sheet conveying path S is nipped and conveyed by the nip region. When passing through the nip region, the toner image on the surface of the photoconductor drum 11 is transferred onto the sheet. The cleaning device 14 removes and collects residual toner from the surface of the photoconductor drum 13 after the developing process and the image transfer process. The structure of the transfer roller 15 and the surrounding area thereof will be described in detail later with reference to FIG. 2.

The sheet feed cassette 22 is a cassette for accumulating sheets to be used for image formation and is provided at a lower part of the housing 10. The sheet output tray 26 is provided at an upper part of the housing 10 and is for placing sheets having images formed thereon. The auxiliary tray 28 is provided above the sheet output tray 26 and is for placing sheets having images formed thereon. In a case where a duplex-printing conveying path is provided to the right of the sheet conveying path S, the auxiliary tray 28 may be used as a sheet receiver where a sheet having an image fixed thereon is switched back so as to be sent toward the duplex-printing conveying path.

In the image forming apparatus 1, a sheet fed from the sheet feed cassette 22 travels through the transfer roller 15 and the fixing unit 17 along the sheet conveying path S so as to be sent to the sheet output tray 26. The sheet conveying path S is provided toward one sidewall (i.e., the right sidewall in FIG. 1) of the housing 10 and has a pickup roller 23, a registration roller 24, a branch guide 27, a sheet output roller 25, and an auxiliary sheet output roller 29.

The pickup roller 23 is provided near an end of the sheet feed cassette 22 and feeds sheets one by one from the sheet feed cassette 22 to the sheet conveying path S. The registration roller 24 temporarily retains each sheet conveyed from the sheet feed cassette 22 and conveys the sheet to the transfer roller 15 at a timing at which the leading edge of the toner image on the photoconductor drum 11 is aligned with the leading edge of the sheet.

The fixing unit 17 has a fixing belt 21 wrapped around a fixing roller 18 and a heating roller 20 and presses a pressure roller 19 against the fixing roller 18 via the fixing belt 21. When a sheet having an unfixed toner image formed thereon is to be nipped and conveyed between the fixing belt 21 and the pressure roller 19, the fixing unit 17 fixes the unfixed toner image onto the sheet by fusing the unfixed toner image onto the sheet using heat and pressure.

The sheet after the fixing process is conveyed so as to travel via the branch guide 27. Starting from the branch guide 27, the sheet conveying path S is branched into a path extending toward the sheet output roller 25 and a path extending toward the auxiliary sheet output roller 29 located higher than the sheet output roller 25. A sheet traveling via the sheet output roller 25 is output onto the sheet output tray 26, whereas a sheet traveling via the auxiliary sheet output roller 29 is output onto the auxiliary tray 28. Whether a sheet having an image formed thereon is to be output onto the sheet output tray 26 or the auxiliary tray 28 can be controlled in accordance with the operation of the branch guide 27.

The toner bottle 30 is provided above the exposure device 12 and near the fixing unit 17 (i.e., left of the fixing unit 17 in FIG. 1) and contains therein toner to be fed to the developing device 13. The duct 40 is provided between the sheet output tray 26 and the exposure device 12 and sends air taken in from outside the housing 10 into the interior thereof. The auxiliary duct 50 is provided below the exposure device 12 and sends air taken in from outside the housing 10 to the interior thereof.

Figure 2:
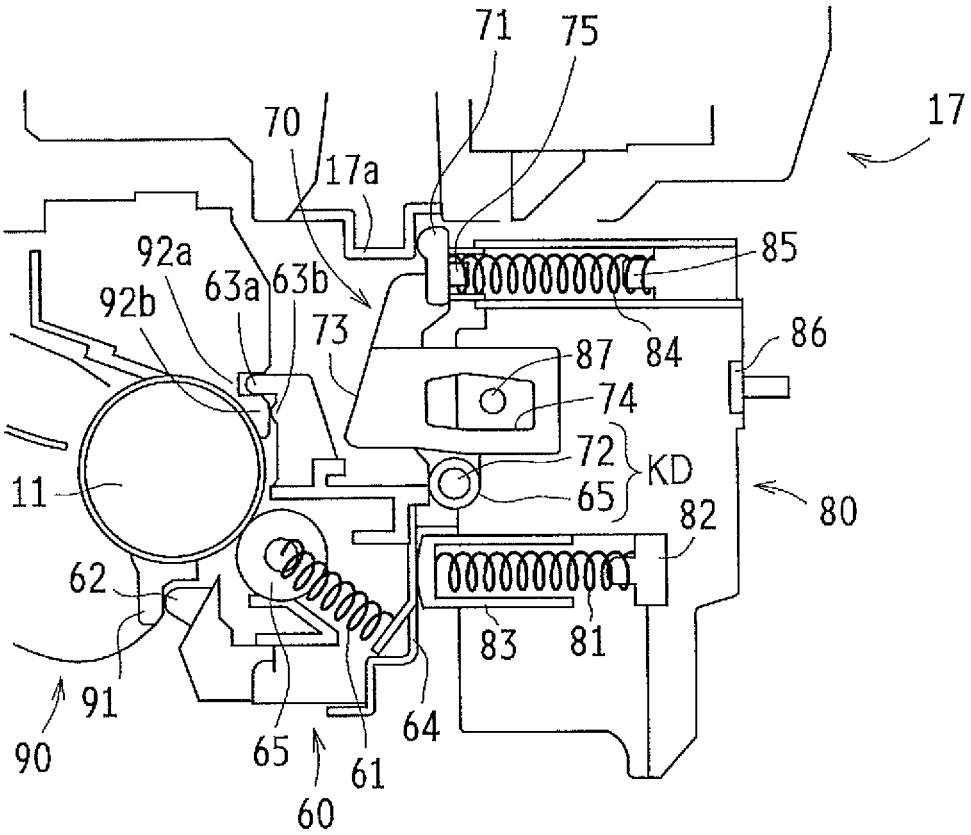
FIG. 2 is a partially enlarged view illustrating a transfer roller and a surrounding area thereof in FIG. 1.
Figure 3:
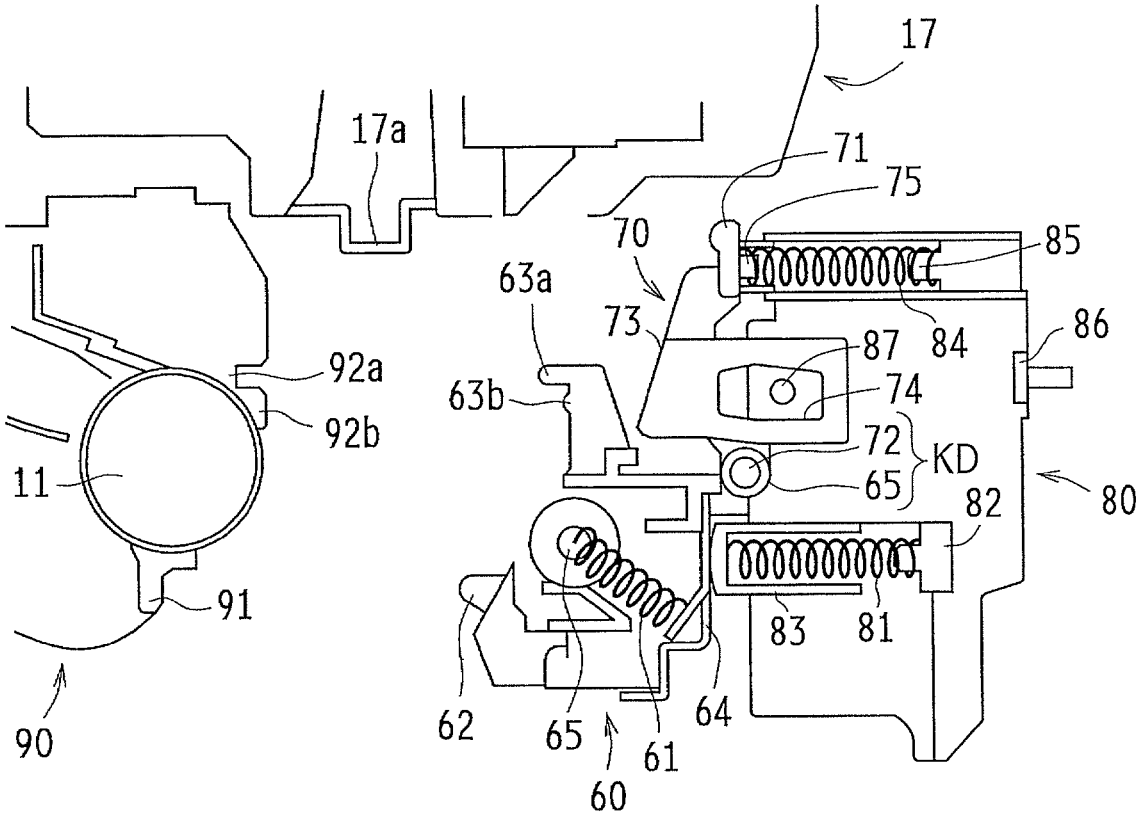
FIG. 3 is a partially enlarged view illustrating the transfer roller and the surrounding area thereof in a state where a support holder is moved.

FIG. 2 is a partially enlarged view illustrating the transfer roller 15 and the surrounding area thereof in FIG. 1. FIG. 3 is a partially enlarged view illustrating the transfer roller 15 and the surrounding area thereof in a state where a support holder is moved. In FIGS. 2 and 3, some components and hatched sections have been omitted for providing a better understanding of the drawings.

The photoconductor drum 11 is supported by a photoconductor unit 90, together with the developing device 13, the cleaning device 14, and the charging device 16 described above. In the sheet conveying direction in the sheet conveying path S, the photoconductor unit 90 is provided with an upstream photoconductor abutment part 91 upstream of the photoconductor drum 11, and is also provided with a first downstream photoconductor abutment part 92*a* and a second downstream photoconductor abutment part 92*b* that are disposed downstream of the photoconductor drum 11. The upstream photoconductor abutment part 91, the first downstream photoconductor abutment part 92*a*, and the second downstream photoconductor abutment part 92*b* are, but not limited to, recesses or flat surfaces, and may alternatively be projections or holes, depending on the shape of a region corresponding to a transfer unit 60 to be described later.

The transfer unit 60, a sheet guide 70, and a support holder 80 are provided facing the photoconductor unit 90 with the sheet conveying path S interposed therebetween.

The transfer roller 15 is supported in a rotatable manner by the transfer unit 60 via a shaft bearing (not illustrated). A roller biasing member 61 is attached between the shaft bearing and the transfer unit 60. The roller biasing member 61 has opposite ends respectively fixed to the transfer roller 15 and the transfer unit 60 and biases the transfer roller 15 toward the photoconductor drum 11.

The transfer unit 60 is provided with an upstream transfer positioning part 62 (i.e., an example of a transfer positioning part) at a position corresponding to the upstream photoconductor abutment part 91 mentioned above, a first downstream transfer positioning part 63*a* (i.e., an example of a transfer positioning part) at a position corresponding to the first downstream photoconductor abutment part 92*a* mentioned above, and a second downstream transfer positioning part 63*b* (i.e., an example of a transfer positioning part) at a position corresponding to the second downstream photoconductor abutment part 92*b* mentioned above. The upstream transfer positioning part 62, the first downstream transfer positioning part 63*a*, and the second downstream transfer positioning part 63*b* are, but not limited to, protrusions protruding toward the photoconductor unit 90 from the surrounding areas thereof, and may alternatively be projections or holes. In the following description, the first downstream transfer positioning part 63*a* and the second downstream transfer positioning part 63*b* may be collectively regarded as a downstream transfer positioning part.

The fixing unit 17 is provided above the transfer unit 60, that is, downstream thereof in the conveying direction, and the sheet guide 70 is provided between the transfer unit 60 and the fixing unit 17. The transfer unit 60 and the sheet guide 70 are joined to each other by an engagement part KD that engages the transfer unit 60 and the sheet guide 70 with each other. Specifically, the engagement part KD includes a transfer engagement part 65 provided in the transfer unit 60 and a guide engagement part 72 provided in the sheet guide 70. The transfer engagement part 65 is provided at an end of the transfer unit 60 (i.e., an upper right end of the transfer unit 60 in FIG. 2) and is substantially ring-shaped. The guide engagement part 72 is provided at a lower part of the sheet guide 70 and is substantially columnar-shaped. In other words, by fitting the guide engagement part 72 to the transfer engagement part 65, the sheet guide 70 becomes engaged with the transfer unit 60 in a state where the sheet guide 70 is rotatable about the guide engagement part 72.

The sheet guide 70 is provided with a sheet guide surface 73 facing the sheet conveying path S and is also provided with a guide positioning part 71 at the upper end. The guide positioning part 71 is a protrusion protruding toward a fixation receiver 17*a* of the fixing unit 17. The fixation receiver 17*a* is provided at a lower part of the fixing unit 17. Although the fixation receiver 17*a* overlaps the sheet conveying path S in FIG. 2, the guide positioning part 71 and the fixation receiver 17*a* are actually provided at positions where they do not overlap a sheet in the sheet width direction and thus do not inhibit the sheet conveying process. Furthermore, a plurality of guide positioning parts 71 and a plurality of fixation receivers 17*a* may be provided such that the positions thereof vary in the sheet width direction.

The transfer unit 60 and the sheet guide 70 are supported by the support holder 80. The support holder 80 is provided opposite from the photoconductor unit 90 relative to the transfer unit 60 and the sheet guide 70. The image forming apparatus 1 has a structure in which a side surface of the housing 10 is partially openable and closable, and the support holder 80 is fixed to the side surface by using, for example, a screw 86. In other words, when the side surface is opened, the support holder 80, the transfer unit 60, and the sheet guide 70 are moved together (see FIG. 3).

The support holder 80 is provided with a transfer biasing member 81 between the support holder 80 and the transfer unit 60. The transfer biasing member 81 is, for example, a coil spring whose one end is fixed to a first stationary boss 82 of the support holder 80 and whose other end is covered with an abutment cover 83. The abutment cover 83 substantially has a shape of a tube with one open end, and the other closed end is in contact with an abutment surface 64 of the transfer unit 60. The abutment surface 64 is located at a surface of the transfer unit 60 opposite from the photoconductor unit 90. The transfer unit 60 is biased toward the transfer biasing member 81 via the abutment cover 83 in a direction extending toward the photoconductor unit 90.

Moreover, the support holder 80 is provided with a guide biasing member 84 between the support holder 80 and the sheet guide 70. The guide biasing member 84 is, for example, a coil spring whose one end is fixed to a second stationary boss 85 of the support holder 80 and whose other end is fixed to a guide boss 75 of the sheet guide 70. The guide boss 75 is provided at the upper end of the sheet guide 70. In other words, the upper end of the sheet guide 70 is provided with the guide positioning part 71 at the side facing the fixing unit 17 and is also provided with the guide boss 75 at the side facing the support holder 80. The sheet guide 70 is biased toward the guide biasing member 84 in a direction extending toward the fixing unit 17. Accordingly, since a part corresponding to the guide positioning part 71 is biased, the guide positioning part 71 and the fixation receiver 17*a* are reliably in abutment with each other.

The support holder 80 and the sheet guide 70 are engaged with each other by a holder engagement part 87 and a guide retainer part 74. The guide retainer part 74 is provided along a side surface of the support holder 80 and has an opening. The holder engagement part 87 is a protrusion protruding from the side surface of the support holder 80 such that the protrusion is fittable in the opening of the guide retainer part 74. The opening of the guide retainer part 74 is larger than the holder engagement part 87. In other words, when the sheet guide 70 rotates, the holder engagement part 87 becomes hooked to the edge of the opening, so that the rotation range of the sheet guide 70 can be regulated.

As illustrated in FIG. 3, by moving the support holder 80, the transfer unit 60 and the sheet guide 70 move away from the photoconductor unit 90 and the fixing unit 17. Accordingly, the sheet conveying path S becomes exposed, thereby achieving improved workability when a paper jam occurs or when performing maintenance.

By closing the side surface of the image forming apparatus 1 from the state illustrated in FIG. 3 and moving the support holder 80 again, the transfer unit 60 and the sheet guide 70 abut on the photoconductor unit 90 and the fixing unit 17. In this case, the upstream transfer positioning part 62 abuts on the upstream photoconductor abutment part 91, the first downstream transfer positioning part 63*a* abuts on the first downstream photoconductor abutment part 92*a*, and the second downstream transfer positioning part 63*b* abuts on the second downstream photoconductor abutment part 92*b*, whereby the transfer unit 60 is positioned relative to the photoconductor unit 90. Because the force for pressing the transfer roller 15 against the photoconductor drum 11 can be adjusted by using the roller biasing member 61, the positional relationship between the photoconductor unit 90 and the transfer unit 60 does not change even when sheets to be conveyed have various thicknesses. The transfer biasing member 81 is set such that the biasing force thereof is stronger than that of the roller biasing member 61. The abutment region between the photoconductor unit 90 and the transfer unit 60, such as between the upstream photoconductor abutment part 91 and the upstream transfer positioning part 62, is provided at a position that does not overlap a sheet in the sheet width direction and thus does not inhibit the sheet conveying process. Furthermore, a plurality of abutment regions between the photoconductor unit 90 and the transfer unit 60 may be provided such that the positions thereof vary in the sheet width direction.

When the side surface of the image forming apparatus 1 is closed, the guide positioning part 71 abuts onto the fixation receiver 17*a* so that the sheet guide 70 is positioned relative to the fixing unit 17.

As described above, the transfer unit 60 and the sheet guide 70 are positioned when they are brought into abutment with the photoconductor unit 90 and the fixing unit 17, so that the accuracy of the attachment positions can be improved, thereby allowing for a stable sheet conveying process. Furthermore, since the transfer unit 60 and the sheet guide 70 are joined to each other, positional displacement therebetween can be regulated and the gap therebetween is less likely to change, thereby suppressing the occurrence of a paper jam between the transfer unit 60 and the sheet guide 70.

In this embodiment, the transfer unit 60 is provided with two transfer positioning parts that are separated from each other at an upstream side and a downstream side in the sheet conveying direction. The engagement part KD is provided between the two transfer positioning parts in the sheet conveying direction. Accordingly, by performing the positioning process at a plurality of locations, the accuracy of the attachment positions can be further improved.

Figure 4:
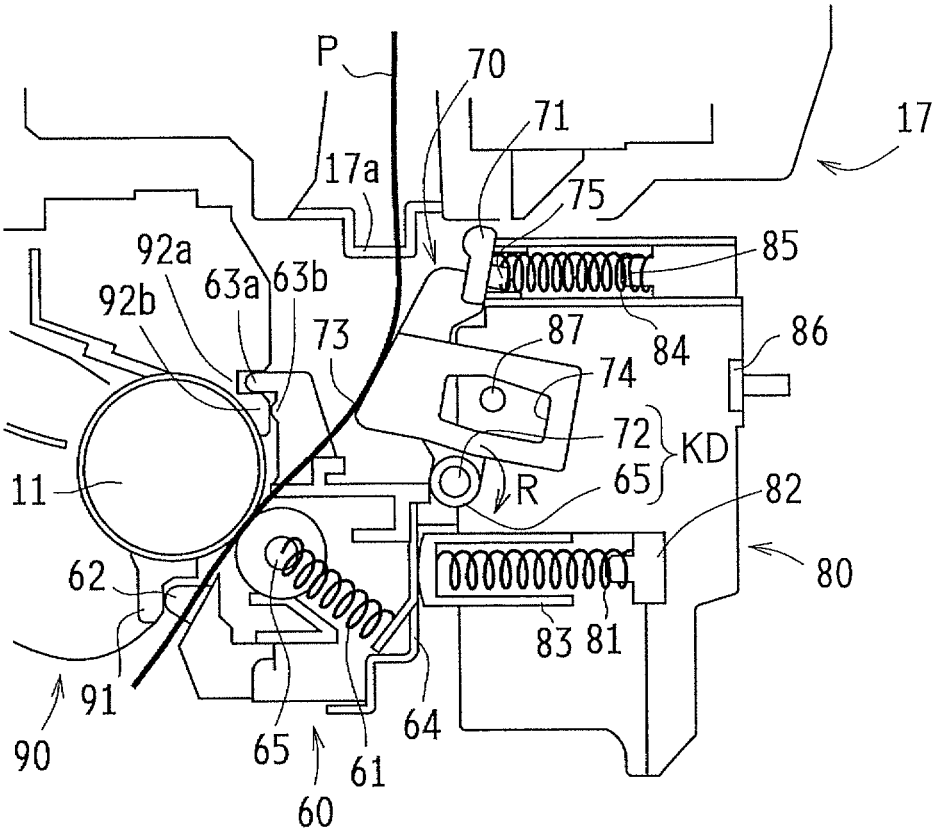
FIG. 4 is a partially enlarged view illustrating the transfer roller and the surrounding area thereof in a state where a sheet is being conveyed.

FIG. 4 is a partially enlarged view illustrating the transfer roller 15 and the surrounding area thereof in a state where a sheet is being conveyed.

The sheet conveying path S is a curved path that protrudes toward the sheet guide 70 between the photoconductor unit 90 and the fixing unit 17. This is because, unless a sheet P conveyed between the fixing unit 17 and the transfer unit 60 is bent, the sheet P would stretch between the fixing unit 17 (such as the fixing roller 13) and the transfer unit 60 (such as the transfer roller 15) and would thus crease or lead to a distorted image. Normally, the sheet conveying rate at the fixing unit 17 is set to be slightly lower than the sheet conveying rate at the transfer unit 60 so that the sheet P becomes bent between the fixing unit 17 and the transfer unit 60.

However, the amount of bending of the sheet P occasionally changes depending on the thickness and size of the conveyed sheet F, sometimes causing the sheet P to curve largely toward the sheet guide 70. However, even in that case, the sheet guide 70 is pressed toward the sheet P so as to rotate away from the sheet conveying path S (in a direction indicated by an arrow R), thereby compensating for the bending of the sheet P. Accordingly, even if the amount of bending of the sheet P changes, the sheet guide 70 rotates so as to adjust the dimensions of the area over which the sheet P travels, thereby suppressing the occurrence of creases and distorted images.

Furthermore, because the sheet guide 70 is rotatable about the engagement part KD acting as a fulcrum and the engagement part KD is disposed toward the support holder 80 relative to the sheet conveying path S, the sheet guide 70 does not rotate simply in response to the leading edge of the sheet P coming into contact with the sheet guide surface 73, due to the relationship between the fulcrum and the point of application. The sheet guide 70 can be effectively rotated only when the sheet P nipped between both the fixing unit 17 and the transfer unit 60 is bent by an amount that exceeds a predetermined amount.

The guide positioning part 71 is provided at an end of the sheet guide 70 opposite from the engagement part KD in the conveying direction of the sheet P. By increasing the distance between the engagement part KD and the guide positioning part 71 as much as possible, the sheet guide 70 can be rotated even with a small force, whereby the sheet guide 70 can be adjusted more reliably.

Second Embodiment

Next, an image forming apparatus according to a second embodiment of the present disclosure will be described with reference to the drawings. Because the structure of the image forming apparatus according to the second embodiment is substantially similar to that in the first embodiment, a description and drawings thereof will be omitted.

The second embodiment is different from the first embodiment in terms of a part that connects the support holder 80 and the transfer unit 60. Each part will be described in detail below with reference to FIGS. 5 and 6.

Figure 5:
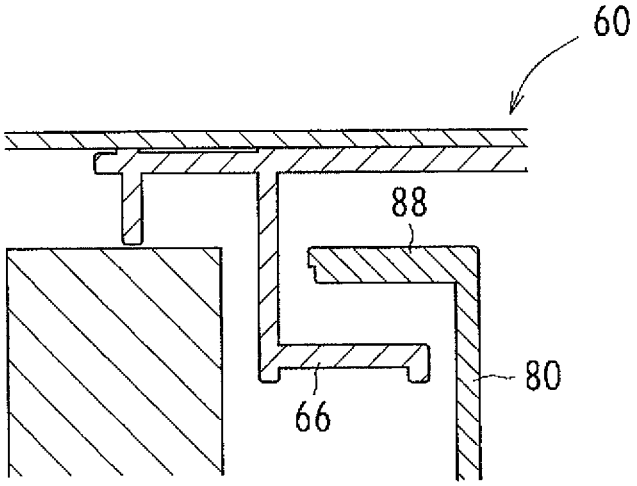
FIG. 5 is an enlarged cross-sectional view illustrating an area where the support holder and a transfer unit are engaged with each other.

FIG. 5 is an enlarged cross-sectional view illustrating an area where the support holder 80 and the transfer unit 60 are engaged with each other.

The support holder 80 and the transfer unit 60 are provided with parts that hook onto each other. In detail, the support holder 80 substantially has a partially cutout shape in a part that faces the transfer unit 60 and is provided with a holder retaining part 88 that partially covers the cutout part. The transfer unit 60 is provided with a transfer regulating part 66 that protrudes toward the cutout part of the support holder 80 and that has a bent end. When the support holder 80 and the transfer unit 60 are combined with each other, the transfer regulating part 66 is partially fitted in the support holder 80, and the bent end of the transfer unit 60 faces the holder retaining part 88. Therefore, when the support holder 80 and the transfer unit 60 move away from each other, the transfer regulating part 66 moves in accordance with the biasing force of the transfer biasing member 81 but hooks onto the holder retaining part 88, so that the support holder 80 and the transfer unit 60 do not become separated from each other.

Figure 6:
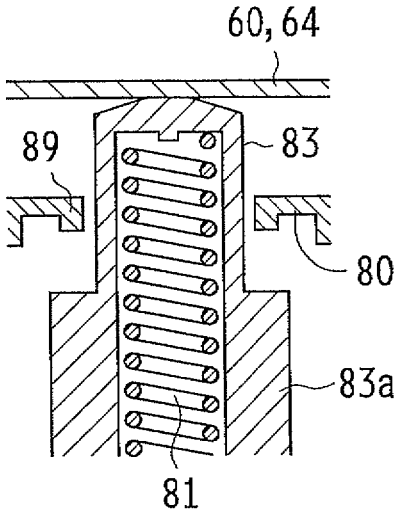
FIG. 6 is an enlarged cross-sectional view illustrating an abutment cover and a surrounding area thereof.

FIG. 6 is an enlarged cross-sectional view illustrating the abutment cover 83 and the surrounding area thereof.

The abutment cover 83 is partially accommodated in the support holder 80 and has an end that protrudes from a side surface of the support holder 80 and that is in contact with the transfer unit 60. The abutment cover 83 is provided with a cover retaining part 83*a* having an outer diameter larger than that of the end thereof. The support holder 80 is provided with a cover through-section 89 at a position corresponding to the abutment cover 83. The cover through-section 89 has a size that is smaller than the outer diameter of the cover retaining part 83*a*. Specifically, when the abutment cover 83 is biased by the transfer biasing member 81 and protrudes from the support holder 80, the cover retaining part 83*a* becomes hooked onto the cover through-section 89 so that the abutment cover 83 does not spring outward from the support holder 80.

Third Embodiment

Next, an image forming apparatus according to a third embodiment of the present disclosure will be described with reference to a drawing. Because the structure of the image forming apparatus according to the third embodiment is substantially similar to that in the first and second embodiments, a description and drawings thereof will be omitted.

Figure 7:
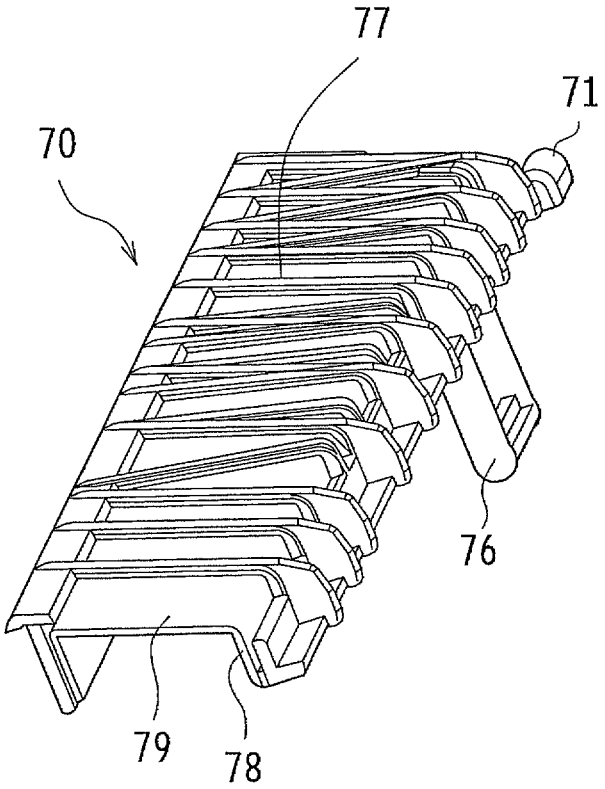
FIG. 7 is a perspective view schematically illustrating a sheet guide.

FIG. 7 is a perspective view schematically illustrating a sheet guide. For illustra the drawing.

The third embodiment is different from the first embodiment in terms of a detailed structure of the sheet guide 70. In detail, the sheet guide 70 has an electrostatic attraction plate 78 that electrostatically attracts a sheet thereto. In the sheet guide 70, the sheet guide surface 73 is constituted of sheet guide ribs 77. The electrostatic attraction plate 78 is connected to a high-voltage power source (not illustrated) that is disposed at a predetermined distance toward the support holder 80 relative to the sheet guide surface 73, so as to electrostatically attract a sheet toward the sheet guide ribs 77. When a sheet is to be conveyed, a voltage with a polarity opposite from the charge polarity of the sheet is applied to an electrode. Accordingly, the sheet is electrostatically attracted to the sheet guide 70 so that inverse bending of the sheet may be suppressed. Consequently, a defective toner image on the sheet caused as a result of the sheet coming into contact with the surroundings may be suppressed.

The electrode (i.e., the electrostatic attraction plate 78) fitted in the sheet guide 70 has a substantially U-shaped cross section and is formed of a metal plate integrally having a sheet facing surface 79 and surfaces extending from opposite edges of the sheet facing surface 79. With such an electrode having a plurality of surfaces, the sheet guide 70 is increased in strength, and deformation of the sheet guide 70 caused as a result of receiving heat from the fixing unit 17 may be suppressed.

The sheet guide ribs 77 extend along the sheet conveying path S and are provided in a plurality at different positions in the sheet width direction. The sheet guide ribs 77 are spaced apart from each other by openings, and the electrostatic attraction plate 78 is disposed deep in the openings. Accordingly, with the openings provided between the sheet guide ribs 77, a gap is provided between the sheet guide surface 73 and the sheet facing surface 79, so that an electrostatic field is effectively applied to a sheet by the electrostatic attraction plate 78, while a paper jam occurring as a result of the sheet being attracted into contact with the electrostatic attraction plate 78 may be suppressed, thereby achieving a smooth sheet conveying process.

A retainer part 76 extending toward the support holder 80 from the sheet guide 70 is another form of the guide retainer part 74. By providing the support holder 80 with a part corresponding to the retainer part 76, a function similar to the guide retainer part 74 is exhibited.

The embodiments disclosed here are exemplary in all aspects and are not intended to act as grounds for limitative interpretations. Therefore, the technical scope of the present disclosure is defined based on the claims and is not to be interpreted solely based on the above-described embodiments. Moreover, all alterations equivalent in meaning to and within the scope of the claims are included.

The present disclosure contains subject matter related to that disclosed in Japanese Priority Patent Application JP 2017-230622 filed in the Japan Patent Office on Nov. 30, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus that transfers a toner image formed on a photoconductor onto a sheet, the image forming apparatus comprising:

a sheet conveying path along which the sheet is conveyed in a conveying direction;

a photoconductor unit that supports the photoconductor;

a transfer roller that is brought into pressure contact with the photoconductor via the sheet conveying path;

a transfer unit that supports the transfer roller;

a sheet guide that is provided between the photoconductor unit and a fixing unit and that guides the sheet along the conveying direction; and a support holder that supports the transfer unit and the sheet guide, wherein the support holder moves to bring the transfer unit and the sheet guide into and out of contact with the photoconductor unit and the fixing unit, wherein the transfer unit is provided with a transfer biasing member between the transfer unit and the support holder and is also provided with a transfer positioning part that positions the transfer unit by coming into abutment with the photoconductor unit, wherein the sheet guide is provided with a guide biasing member between the sheet guide and the support holder and is also provided with a guide positioning part that positions the sheet guide by coming into abutment with the fixing unit, and wherein the transfer unit and the sheet guide are joined to each other by an engagement part that engages the transfer unit and the sheet guide with each other.

2. The image forming apparatus according to claim 1, wherein the sheet guide rotates about the engagement part serving as an axis.

3. The image forming apparatus according to claim 2, wherein the guide positioning part is provided at an end of the sheet guide opposite from the engagement part in the conveying direction.

4. The image forming apparatus according to claim 3, wherein the guide biasing member biases the end provided with the guide positioning part in a direction extending toward the fixing unit.

5. The image forming apparatus according to claim 1, wherein the transfer positioning part includes two transfer positioning parts provided in the transfer unit at locations separated from each other in the conveying direction, and wherein the engagement part is provided between the two transfer positioning parts in the conveying direction.

6. The image forming apparatus according to claim 1, wherein the sheet guide has an electrostatic attraction plate that electrostatically attracts the sheet to the electrostatic attraction plate.

* * * * *